United States Patent [19]

Fujimoto et al.

[11] Patent Number: 4,945,879

[45] Date of Patent: Aug. 7, 1990

[54] FUEL CONTROLLER FOR AN INTERNAL COMBUSTION ENGINE

[75] Inventors: Takanori Fujimoto; Toshiro Hara, both of Himeji, Japan

[73] Assignee: Mitsubishi Denki Kabushiki Kiasha, Tokyo, Japan

[21] Appl. No.: 304,628

[22] Filed: Feb. 1, 1989

[30] Foreign Application Priority Data

Feb. 1, 1988 [JP] Japan ..... 63-22323

[51] Int. Cl.[5] ..... F02D 41/26

[52] U.S. Cl. ..... 123/479; 123/198 D; 123/198 DB

[58] Field of Search ..... 123/198 D, 198 DB, 414, 123/479; 73/119 A; 364/431.09, 431.11

[56] References Cited

U.S. PATENT DOCUMENTS

| | | | |
|---|---|---|---|
| 4,366,794 | 1/1983 | Hachiga et al. | 123/479 |
| 4,395,905 | 8/1983 | Fujimori et al. | 123/479 X |
| 4,602,600 | 7/1986 | Akatsuka et al. | 123/198 D |
| 4,628,882 | 12/1986 | Sakurai et al. | 123/479 |
| 4,664,082 | 5/1987 | Suzuki | 123/414 |
| 4,690,123 | 9/1987 | Kimura et al. | 123/414 X |
| 4,724,816 | 2/1988 | Kanno et al. | 123/491 |
| 4,788,956 | 12/1988 | Suzuki et al. | 123/414 |
| 4,825,691 | 5/1989 | Sekiguchi | 123/479 X |

*Primary Examiner*—Tony M. Argenbright

*Attorney, Agent, or Firm*—Sughrue, Mion, Zinn, Macpeak & Seas

[57] ABSTRACT

A fuel controller for an internal combustion engine has a crank angle sensor which generates a cylinder recognition signal corresponding to a prescribed cylinder of the engine. If a microcomputer 12 determines that the cylinder recognition signal has not changed during the occurrence of a prescribed number of changes in the level of a crank angle signal, the cylinder recognition signal is determined to be abnormal and fuel injectors of the engine are not actuated if the engine has been running for at least a prescribed length of time, thereby cutting off the supply of fuel to the engine.

5 Claims, 5 Drawing Sheets

FUEL CONTROLLER FOR AN INTERNAL COMBUSTION ENGINE

BACKGROUND OF THE INVENTION

This invention relates to a fuel controller for an internal combustion engine which is equipped with a fuel injection system. More particularly, it relates to a fuel controller which can prevent backfiring of the engine due to improper ignition timing.

In an internal combustion engine, it is important that ignition take place at the proper time in each cylinder of the engine. In order to control the ignition timing, a crank angle sensor of the engine generates a cylinder recognition signal that indicates which cylinder is undergoing compression at any given time, and the ignition timing is adjusted in accordance with this signal.

However, if the crank angle sensor malfunctions or if there are bad connectors or broken wires in the electrical system, the cylinder recognition signal may become incorrect. If the ignition timing continues to be controlled on the basis of an incorrect cylinder recognition signal, ignition may end up taking place in a cylinder which is performing suction. This causes backfiring of the engine, which can damage the engine.

SUMMARY OF THE INVENTION

Accordingly, it is an object of the present invention to provide a fuel controller for an internal combustion engine which can prevent backfiring when the ignition timing is not correct.

In a fuel controller for an internal combustion engine in accordance with the present invention, a determining mechanism determines whether a cylinder recognition signal is abnormal on the basis of the cylinder recognition signal and a crank angle signal, both of which are generated by a crank angle sensor. If an abnormality is detected and the engine has been running for at least a prescribed length of time, the supply of fuel to the fuel injectors of the engine is cut off so as to prevent problems such as backfiring.

A fuel controller in accordance with the present invention comprises a crank angle sensor which generates a crank angle signal and a cylinder recognition signal, a determining mechanism which determines whether the cylinder recognition signal is normal, and a fuel supply stopping mechanism which stops the supply of fuel to fuel injectors of the engine when the determining mechanism determines that the cylinder recognition signal is abnormal and the engine has been running for at least a prescribed length of time.

In a preferred embodiment, the determining mechanism determines that the cylinder recognition signal is abnormal when the cylinder recognition signal undergoes no change during the occurrence of a prescribed number of output pulses of the crank angle sensor.

The determining mechanism and the fuel supply stopping mechanism can be separate members, but in a preferred embodiment, they are constituted by a microcomputer.

DESCRIPTION OF THE PREFERRED EMBODIMENT

A preferred embodiment of the present invention will be described hereinafter while referring to the accompanying drawings, FIG. 1 of which schematically illustrates the overall structure of this embodiment as applied to a four-cylinder internal combustion engine.

Figure 1:
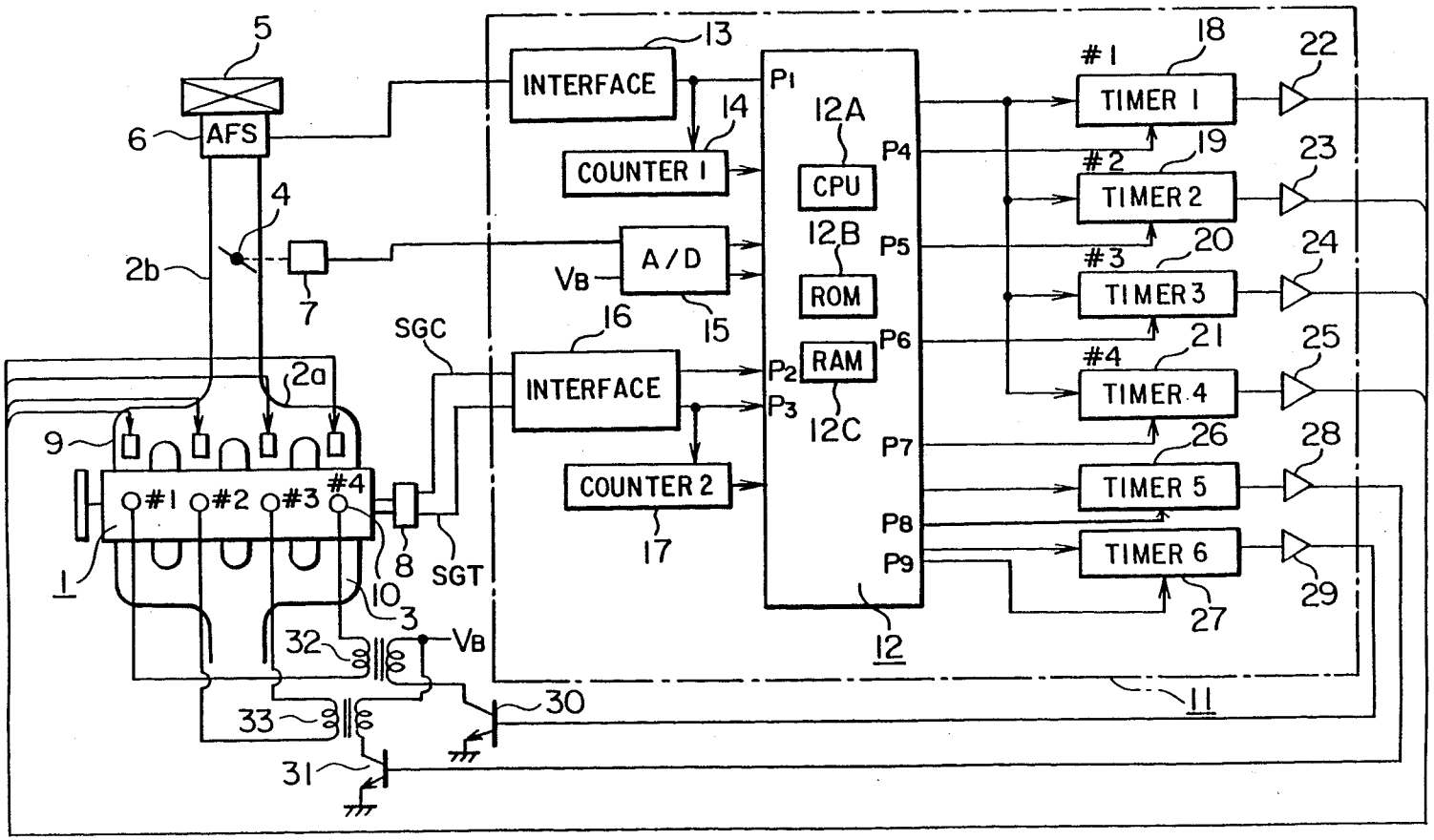
FIG. 1 is a schematic illustration of an embodiment of a fuel controller in accordance with the present invention as applied to a four-cylinder engine.

As shown in FIG. 1, an internal combustion engine 1 has four cylinders labeled #1 through #4. An intake manifold 2*a* is connected to one side of the engine 1 and an exhaust manifold 3 is connected to the other side. An intake pipe 2*b* is connected to the upstream end of the intake manifold 2*a*. A throttle valve 4 is rotatably mounted in the intake pipe 2*b*, and an air cleaner 5 is installed at the upstream end of the intake pipe 2*b*. A Karman vortex air flow sensor 6 (hereinunder referred to as an AFS) is mounted on the intake pipe 2*b* between the throttle valve 4 and the air cleaner 5. It produces an electrical output signal in the form of pulses having a frequency corresponding to the rate at which intake air flows through the intake pipe 2*b*. The degree of opening of the throttle valve 4 is detected by a throttle opening sensor 7 which generates a corresponding electrical output signal. A crank angle sensor 8 detects the rotation of the engine 1 and generates two electrical output signals: a crank angle signal SGT and a cylinder recognition signal SGC. The crank angle signal SGT is generated at prescribed crankshaft angles of the engine 1, such as once for every 180 degrees of crankshaft rotation. The cylinder recognition signal is generated each time a prescribed cylinder is recognized. A fuel injector 9 for supplying fuel is disposed in the intake manifold 2*a* near the unillustrated intake valve of each cylinder, and a spark plug 10 is disposed inside each cylinder.

Figure 2:
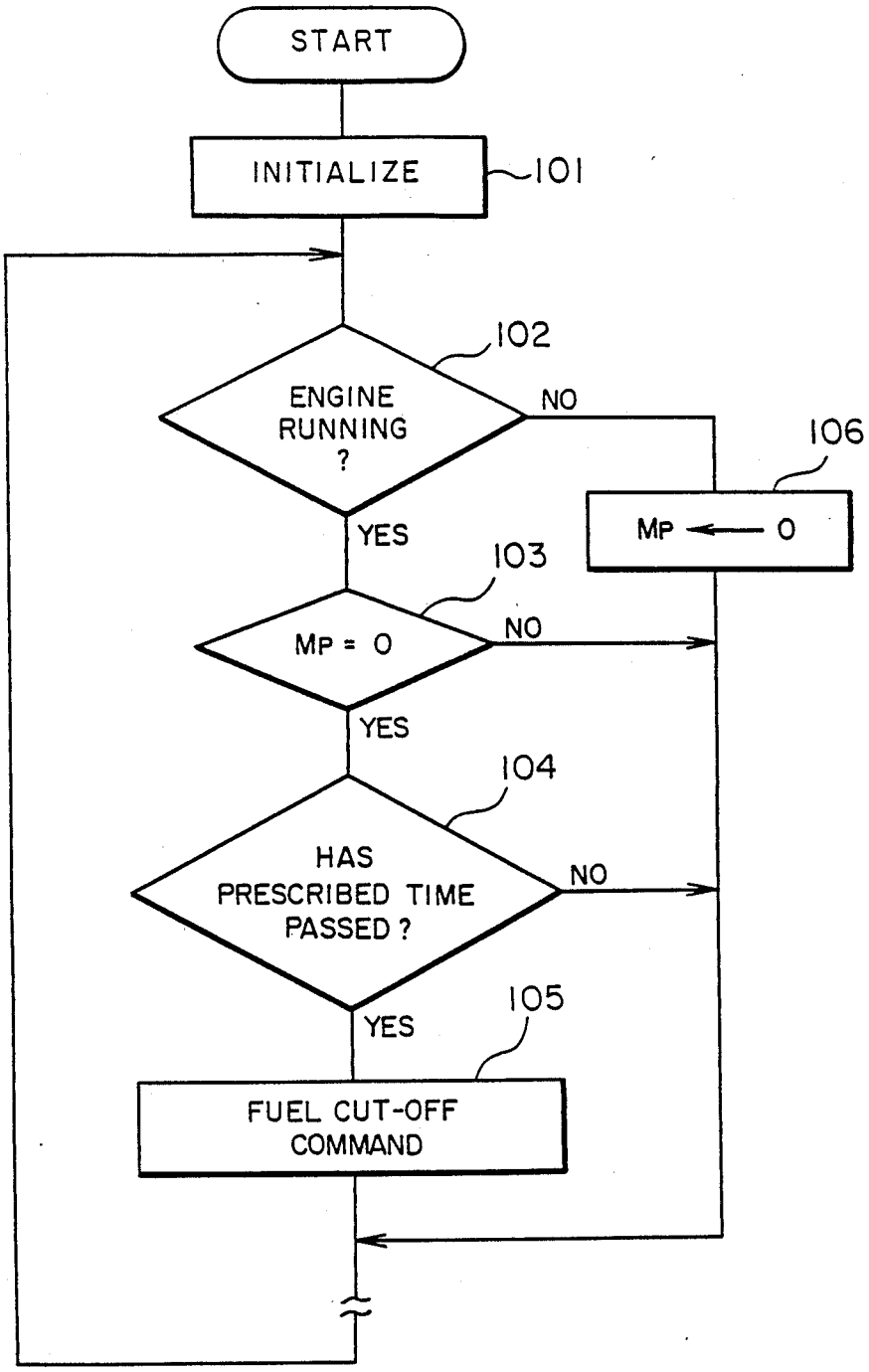
FIG. 2 is a flow chart of the main program performed by the microprocessor 12 of FIG. 1.
Figure 3:
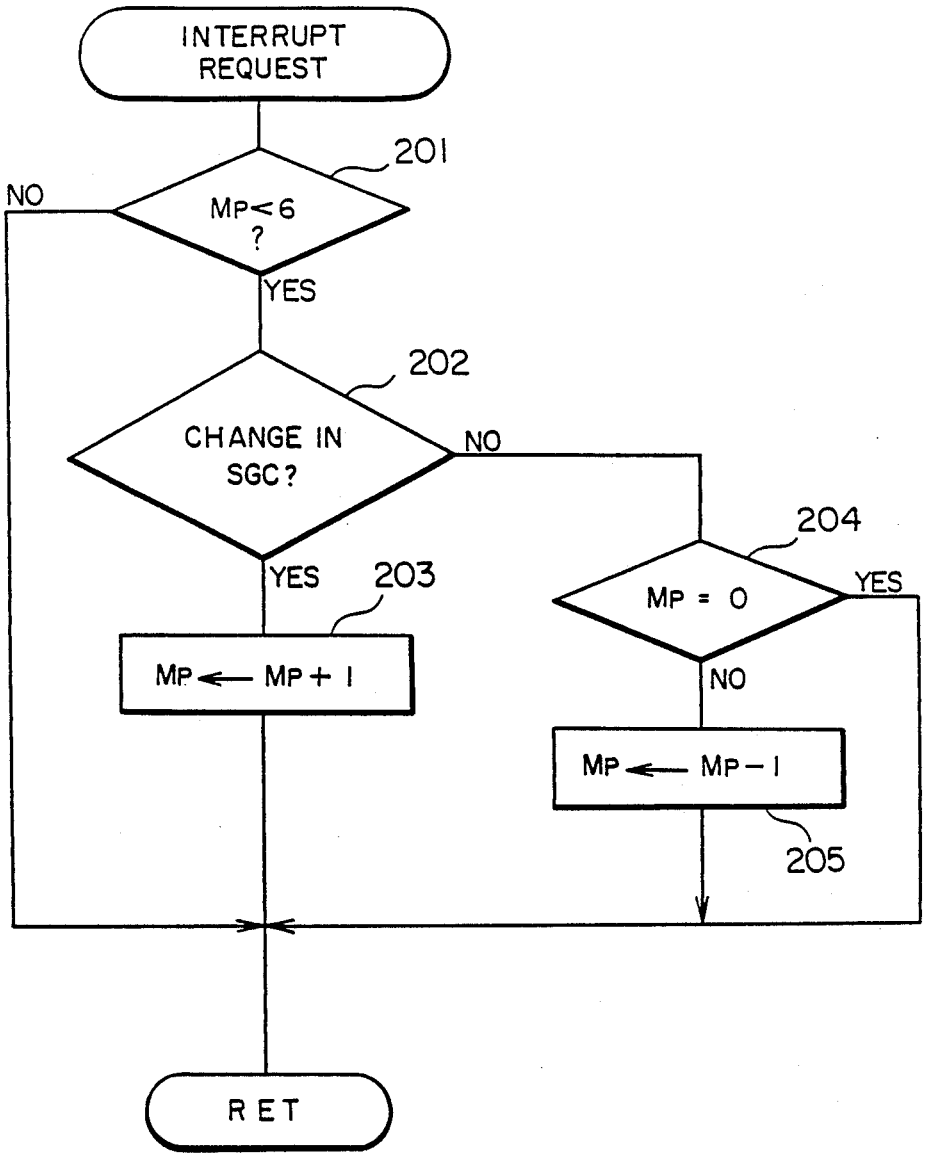
FIG. 3 is a flow chart of an interrupt handling routine performed by the microprocessor 12 of FIG. 1 each time there is a rise in the level of the crank angle signal.

The four fuel injectors 9 and the four spark plugs 10 are controlled by a controller 11 which is responsive to the output signals from the AFS 6, the throttle opening sensor 7, and the crank angle sensor 8 as well as to the voltage VB of an unillustrated battery. The controller 11 is equipped with a microcomputer 12 for performing various calculations and determinations. The microcomputer 12 has a CPU 12A, a ROM 12B which stores various data and the programs which are illustrated in FIGS. 2 and 3, and a RAM 12C which functions as a work area. A first interface 13 is connected between the AFS 6 and an interrupt input port P1 of the microcomputer 12. The output side of the first interface 13 also is connected to a first counter 14 whose output side is connected to the microcomputer 12. The output signal from the throttle opening sensor 7 and the voltage VB of the battery are input to an A/D converter 15 which converts these inputs into digital values and inputs them into the microcomputer 12. The cylinder recognition signal SGC and the crank angle signal SGT from the crank angle sensor 8 are input respectively to an input port P2 and an interrupt input port P3 of the microcomputer 12 via a second interface 16. The crank angle signal SGT also is input to a second counter 17 via the second interface 16, and the output of the second counter 17 is input to the microcomputer 12.

First through fourth timers 18–21 for controlling the timing of the fuel injectors 9 are connected to first through fourth drivers 22–25 which drive the fuel injectors 9. The timers 18–21 are set to prescribed values by an output signal from the microcomputer 12 and are triggered by output signals from output ports P4–P7, respectively. A fifth timer 26 and a sixth timer 27 for controlling the firing of the spark plugs 10 are connected to a fifth driver 28 and a sixth driver 29, respectively, which are connected to the bases of a first transistor 30 and a second transistor 31, respectively. The fifth and sixth timers 26 and 27 are set to prescribed values by output signals from the microcomputer 12 and are triggered by output signals from output ports P8 and P9 of the microcomputer 12.

The emitters of both transistors 30 and 31 are grounded. The collectors of transistors 30 and 31 are connected to the unillustrated battery which has a voltage VB through the primary windings of a first ignition coil 32 and a second ignition coil 33, respectively. The ends of the secondary winding of the first ignition coil 32 are connected to the spark plugs 10 for the first and fourth cylinders, while the ends of the secondary winding of the second ignition coil 33 are connected to the spark plugs 10 for the second and third cylinders of the engine 1.

The operation of the embodiment of FIG. 1 is as follows. The output signal from the AFS 6 is input to interrupt input port P1 through the first interface 13. Each time the level of the output signal from the AFS 6 rises, the microcomputer 12 performs an interrupt routine and the period of the output pulses is measured by the first counter 14. The output of the throttle opening sensor 7 and the battery voltage VB are converted to digital values by the A/D converter 15 and are read in by the microcomputer 12 at prescribed intervals. These values are used in calculating the fuel supply. The cylinder recognition signal SGC from the crank angle sensor 8 is provided to input port P2 of the microcomputer 12 through the second interface 16 while the crank angle signal SGT is provided to both the second counter 17 and to interrupt input port P3 through the second interface 16. An interrupt takes place each time the level of the crank angle signal SGT rises, and the second counter 2 measures the period of the crank angle signal SGT.

Based on the above-described input signals, the microcomputer 12 calculates the fuel supply and the ignition timing in accordance with well-known algorithms. Based on the results of the calculations, the first through fourth timers 18–21 are set to suitable values for driving the fuel injectors 9, and the fifth and sixth timers 26 and 27 are set to suitable values for driving the spark plugs 10. After the timers have been set, they are triggered in succession by the microcomputer 12 and the four fuel injectors 9 are actuated in succession by the first through fourth drivers 22–25 so that each cylinder is supplied fuel by the corresponding fuel injector 9 during its suction stroke. The fifth and sixth timers 26 and 27 are triggered alternately by the microcomputer so that drive signals are sent alternately to the first and second transistors 30 and 31 by the fifth and sixth drivers 28 and 29, respectively. This causes the first and second ignition coils 32 and 33 to conduct alternately, whereby the spark plugs 10 for the first and fourth cylinders and then the spark plugs 10 for the second and third cylinders are made alternately to fire. Although two spark plugs 10 are fired at a time, the cylinder for one of the two spark plugs 10 is performing compression while the other cylinder is performing exhaust, so fuel is ignited in only one cylinder at a time.

After the engine 1 has been running for at least a prescribed length of time, if the microcomputer 12 determines that the cylinder recognition signal SGC is abnormal, the microcomputer 12 stops applying trigger signals to the first through fourth timers 18–21 through output ports P4–P7 and thereby stops the supply of fuel to the fuel injectors 9.

The operation of the microcomputer 12 when it controls the fuel injectors 9 will be explained in greater detail while referring to the flow charts of FIGS. 2 and 3. FIG. 2 is a flow chart of the main program performed by the microcomputer 12. In Step 101, initialization is performed. This initialization step includes setting a value referred to as the cylinder recognition signal abnormality indicator MP (referred to as the "cylinder abnormality indicator" for short) equal to 0. Next, in Step 102, it is determined whether the engine 1 is running or not. This determination is made on the basis of the crank angle signal SGT; if the crank angle sensor 8 is generating a crank angle signal SGT, then it is determined that the engine 1 is running. If the engine 1 running, then in Step 103, it is determined whether the cylinder abnormality indicator MP is 0. If MP=0, then in Step 104, it is determined whether a prescribed length of time has passed since the engine 1 started. If this length of time has passed, it is determined that the cylinder recognition signal SGC is abnormal, so in Step 105, a fuel supply cut-off command is issued so that the first through fourth timers 18–21 are not triggered and the supply of fuel to the cylinders is cut off. On the other hand, if it is determined in Step 102 that the engine is not running, then in Step 106, the cylinder abnormality indicator MP is set equal to 0.

Step 105 is followed by a number of conventional steps in which the fuel injection timing and the ignition timing are calculated. As these subsequent steps are well known to those skilled in the art a detailed description thereof will be omitted. After the completion of the unillustrated steps, the main program returns to Step 102.

FIG. 3 is a flow chart of an interrupt handling routine which is performed each time the level of the crank angle signal SGT rises. First, in Step 201, the cylinder abnormality indicator MP is compared with a prescribed value, such as 6. If MP is greater than or equal to 6, it is determined that the cylinder recognition signal SGC is normal, and the main program is returned to. However, if MP<6, then in Step 202, it is determined whether there was a change in the level of the cylinder recognition signal SGC since the last time that the interrupt handling routine was performed. If there was a change in the level of SGC, then the cylinder abnormality indicator is incremented by 1, after which the main program is returned to. If there was no change in the level of SGC, then in Step 204, it is determined whether MP is equal to 0. If MP=0, then the main program is returned to. If MP is not equal to 0, then in Step 205, MP is decreased by 1 and the main program is returned to.

Figure 4:
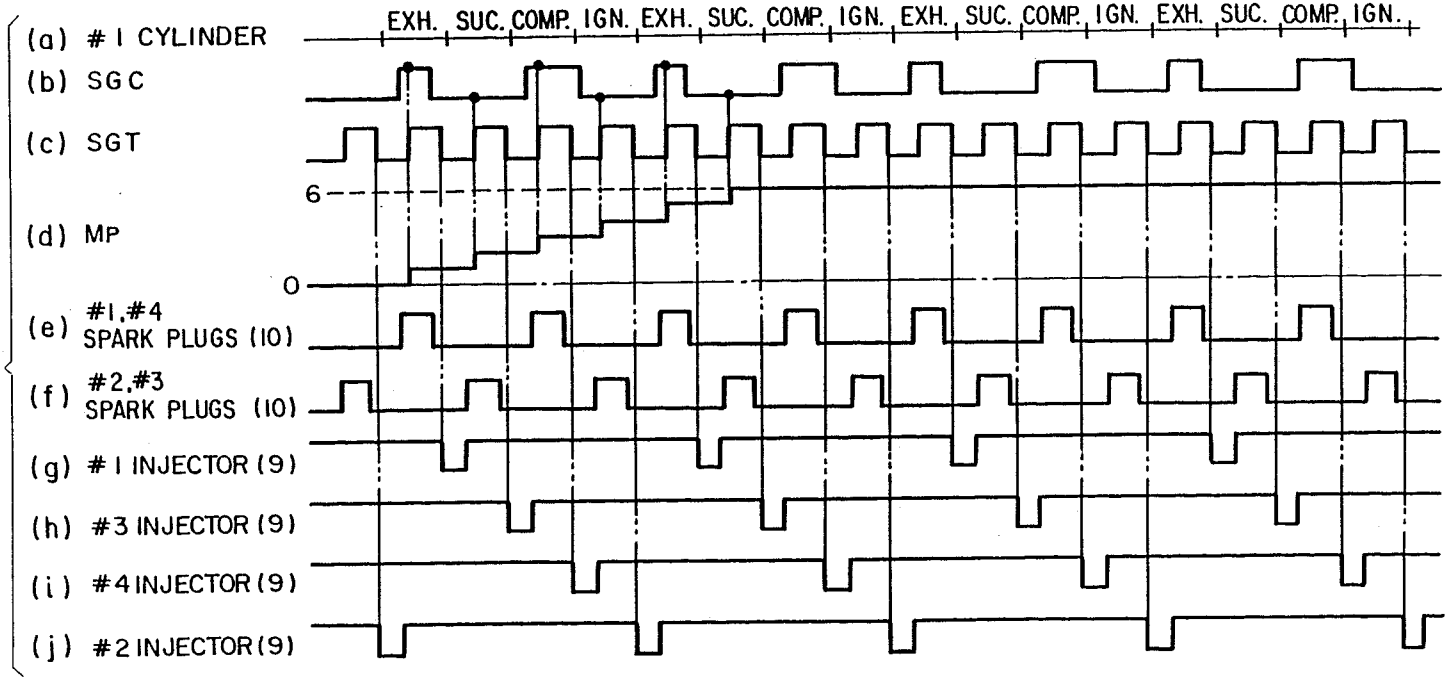
FIGS. 4(*a–j*) are a waveform diagram of the outputs of various elements of the embodiment of FIG. 1 during normal operation.
Figure 5:
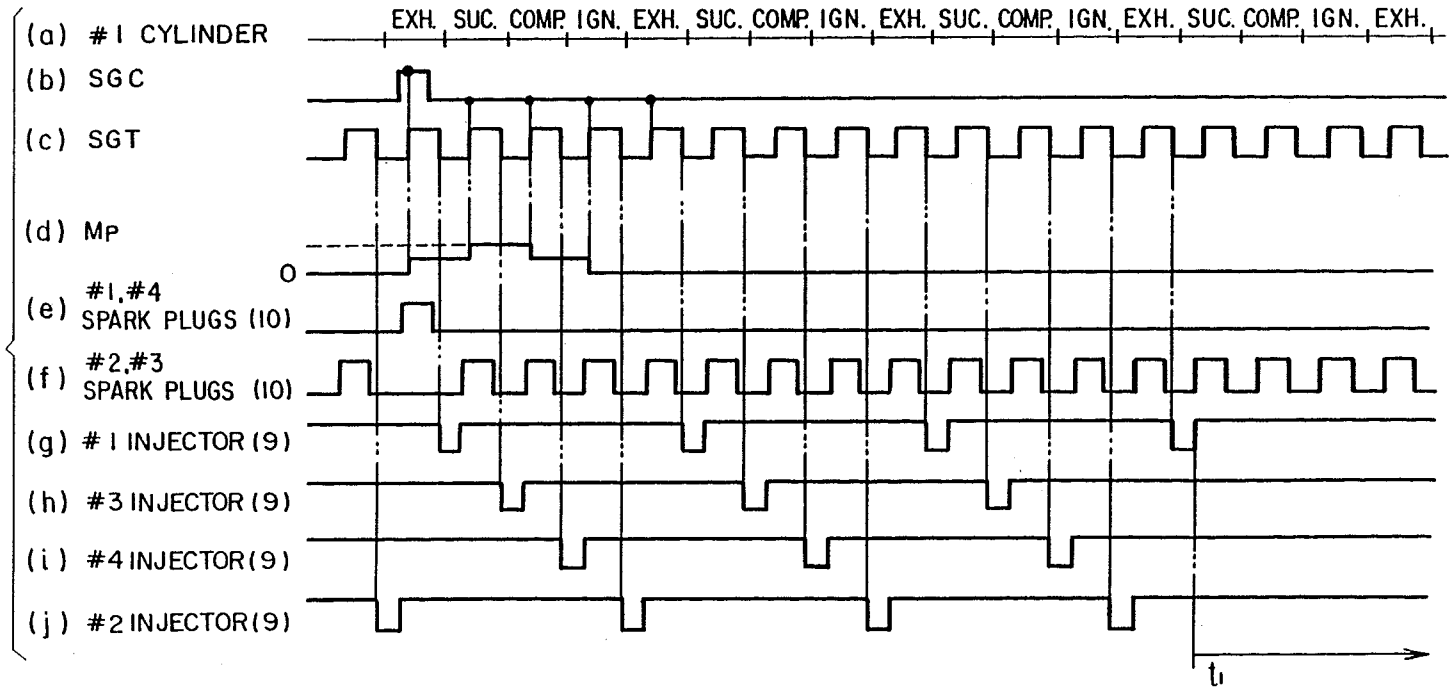
FIGS. 5(*a–j*) are a waveform diagram of the outputs of the same elements when the cylinder recognition signal is abnormal.

FIGS. 4 and 5 illustrate the values of various signals and parameters of the embodiment of FIG. 1 during normal operation and abnormal operation, respectively. In each figure, (a) indicates the action being performed (EXH=exhaust, SUC=suction, COMP=compression, IGN=ignition) by the first cylinder, (b) shows the value of the cylinder recognition signal SGC, (c) shows the value of the crank angle signal SGT, (d) shows the value of the cylinder abnormality indicator MP, (e) shows the firing signal for the spark plugs 10 in the first and fourth cylinders, (f) shows the firing signal for the spark plugs 10 in the second and third cylinders, and (g)–(j) show the drive signals for the fuel injectors 9 of the first, third, fourth, and second cylinders, respectively.

As shown in FIG. 4, when the engine 1 is operating normally, the level of the cylinder recognition signal SGC is the opposite of its previous value each time the level of the crank angle signal SGT rises. As a result, the value of MP is incremented successfully by the interrupt routine of FIG. 3 until MP reaches 6, after which it remains at this level. Therefore, when Step 201 of the interrupt handling routine is performed, it is determined that MP is greater than or equal to 6, so fuel is supplied to the fuel injectors 9 in the normal manner.

FIG. 5 illustrates an abnormal state in which, due to some malfunction, the cylinder recognition signal SGC does not alternate as it should and remains low. Therefore, after MP reaches a value of 2, it decreases to 0. Due to the abnormal cylinder recognition signal SGC, only the spark plugs 10 for the second and third cylinders ignite while the other two spark plugs 10 do not. When this state continues for a prescribed length of time after the starting of the engine 1, it is determined that the cylinder recognition signal SGC is abnormal, and after time tl, the first through fourth timers 18–21 are not triggered and the supply of fuel to the fuel injectors 9 is cut off. As shown in FIG. 5, after time t1, the drive signals for the injectors 9 remain constant.

As a result, the engine is prevented from running when the ignition timing is incorrect, and damage to the engine due to backfiring can be prevented.

In the above-described embodiment, it is determined whether the engine is running or not using the crank angle signal SGT, but it is possible to employ other signals instead, such as the on-off signal of the cranking switch of the engine 1.

What is claimed is:

1. A fuel controller for an internal combustion engine comprising:

a crank angle sensor which generates a crank angle signal whose level changes at one or more prescribed crankshaft angles of the engine and a cylinder recognition signal which indicates a prescribed cylinder of the engine;

determining means for determining whether the cylinder recognition signal is abnormal on the basis of the crank angle signal and the cylinder recognition signal; and fuel cut-off means for cutting off the supply of fuel to the engine if the determining means determines that the cylinder recognition signal is abnormal and the engine has been running for at least a prescribed length of time.

2. A fuel controller as claimed in claim 1, wherein said determining means and said fuel cut-off means are constituted by a microcomputer.

3. A fuel controller as claimed in claim 1, wherein said determining means comprises means for determining whether the level of said cylinder recognition signal has changed during the occurrence of a prescribed number of changes in the level of the crank angle signal.

4. A method of controlling the supply of fuel to an internal combustion engine having a crank angle sensor which generates a crank angle signal whose level changes at one or more prescribed crankshaft angles of the engine and a cylinder recognition signal corresponding to a prescribed cylinder of the engine, comprising:

determining whether the cylinder recognition signal is abnormal; and shutting off the supply of fuel to the engine if the cylinder recognition signal is determined to be abnormal and the engine has been running for at least a prescribed length of time.

5. A method as claimed in claim 4, wherein said cylinder recognition signal is determined to be abnormal when the level thereof has not changed during the occurrence of a prescribed number of changes in the level of the crank angle signal.

* * * * *